US010226081B2

(12) United States Patent
Berns et al.

(10) Patent No.: US 10,226,081 B2
(45) **Date of Patent: *Mar. 12, 2019**

(54) GARMENT INCLUDING AND ADJUSTMENT ARRANGEMENT

(71) Applicant: Under Armour, Inc., Baltimore, MD (US)

(72) Inventors: Jason Berns, Crofton, MD (US); Merida Miller, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 331 days.

This patent is subject to a terminal disclaimer.

(21) Appl. No.: 15/162,678

(22) Filed: May 24, 2016

(65) Prior Publication Data

US 2016/0262461 A1 Sep. 15, 2016

Related U.S. Application Data

(63) Continuation of application No. 13/837,848, filed on Mar. 15, 2013, now Pat. No. 9,357,807.

(51) Int. Cl.

| | |
|---|---|
| ***A41C 3/00*** | (2006.01) |
| ***A41F 19/00*** | (2006.01) |
| ***A41D 15/00*** | (2006.01) |
| ***A41F 9/02*** | (2006.01) |
| ***A43C 9/00*** | (2006.01) |

(52) U.S. Cl.

CPC ..... *A41C 3/0028* (2013.01); *A41D 15/00* (2013.01); *A41D 15/002* (2013.01); *A41F 9/025* (2013.01); *A41F 19/00* (2013.01); *A43C 9/00* (2013.01); *Y10T 24/2187* (2015.01)

(58) Field of Classification Search

CPC ..... A41D 1/06; A41D 13/1254; A41B 9/00
USPC ..... 2/64, 70, 72, 76, 79, 227, 228, 237
See application file for complete search history.

(56) References Cited

U.S. PATENT DOCUMENTS

| | | | |
|---|---|---|---|
| 104,419 | A | 6/1870 | Buffington |
| 187,405 | A | 2/1877 | Moulton |
| 222,262 | A | 12/1879 | Felt |
| 359,330 | A | 3/1887 | Smadbeck |
| 1,061,686 | A | 5/1913 | Nichols |
| 2,398,258 | A | 4/1946 | Seegal |
| 2,470,031 | A | 5/1949 | Harris |
| 2,897,508 | A | 8/1959 | Bashore et al. |
| 4,164,792 | A | 8/1979 | Ito |
| 5,157,813 | A | 10/1992 | Carroll |

(Continued)

FOREIGN PATENT DOCUMENTS

| | | | |
|---|---|---|---|
| JP | 2001303335 | A | 10/2001 |
| JP | 2009024273 | A | 2/2009 |

*Primary Examiner* — Katherine M Moran

(57) ABSTRACT

A size adjustment arrangement for a garment comprises a base member, a ratchet member, a line, a spool, and an actuator. The line is wound on the spool with the line extending through at least one channel in the garment. The actuator is selectively rotatable in a first direction and a second direction without activation of any release mechanism. When a first force is applied to rotate the actuator in the first direction, the line is wound upon the spool. When a second force is applied to rotate the actuator in the second direction, the line is unwound upon the spool. The ratchet member and the spool are blocked from rotation when neither the first force nor the second force is applied to the actuator.

14 Claims, 6 Drawing Sheets

(56) References Cited

U.S. PATENT DOCUMENTS

| | | | | |
|---|---|---|---|---|
| 5,263,202 | A | 11/1993 | Siberell | |
| 5,425,161 | A | 6/1995 | Schoch | |
| 5,433,648 | A | 7/1995 | Frydman | |
| 5,533,210 | A | 7/1996 | Maderek et al. | |
| 5,934,599 | A | 8/1999 | Harnmerslag | |
| 5,946,724 | A | 9/1999 | Erickson | |
| 6,185,743 | B1 | 2/2001 | Mick | |
| 6,202,953 | B1 | 3/2001 | Harnmerslag | |
| 6,289,558 | B1 | 9/2001 | Harnmerslag | |
| 6,317,894 | B1 | 11/2001 | Blechman | |
| 7,076,843 | B2 | 7/2006 | Sakabayashi | |
| 7,171,695 | B2 | 2/2007 | Braun | |
| 7,360,282 | B2 | 4/2008 | Borsoi | |
| 7,412,728 | B2 | 8/2008 | Alesina et al. | |
| 7,591,050 | B2 | 9/2009 | Hammerslag | |
| 7,950,112 | B2 | 5/2011 | Hammerslag et al. | |
| 7,954,204 | B2 | 6/2011 | Hammerslag et al. | |
| 7,992,261 | B2 | 8/2011 | Hammerslag et al. | |
| 8,091,182 | B2 | 1/2012 | Hammerslag et al. | |
| 9,357,807 | B2 * | 6/2016 | Berns | A41F 19/00 |
| 2007/0264905 | A1 | 11/2007 | Horta et al. | |
| 2008/0066272 | A1 | 3/2008 | Hammerslag et al. | |
| 2009/0172928 | A1 | 7/2009 | Messmer et al. | |
| 2009/0287128 | A1 | 11/2009 | Ingimundarson et al. | |
| 2010/0139057 | A1 | 6/2010 | Soderberg et al. | |
| 2010/0175163 | A1 | 7/2010 | Litke | |
| 2010/0306901 | A1 | 12/2010 | Erickson | |
| 2011/0072566 | A1 | 3/2011 | Kovacevich et al. | |
| 2011/0225843 | A1 | 9/2011 | Kerns et al. | |
| 2011/0258876 | A1 | 10/2011 | Baker et al. | |
| 2011/0266384 | A1 | 11/2011 | Goodman et al. | |
| 2012/0004587 | A1 | 1/2012 | Nickel et al. | |
| 2013/0203319 | A1 | 8/2013 | Torres et al. | |

* cited by examiner

GARMENT INCLUDING AND ADJUSTMENT ARRANGEMENT

CROSS REFERENCE TO RELATED APPLICATIONS

The present application is a continuation of U.S. application Ser. No. 13/837,848, filed 15 Mar. 2013 and entitled "Size Adjustment Arrangement for a Garment," U.S. Pat. No. 9,357,807, the disclosure of which is incorporated herein by reference in its entirety

FIELD OF THE INVENTION

This document relates to the field of garments and other apparel and particularly to garments having size adjustment capabilities.

BACKGROUND OF THE INVENTION

It is known to use adjustment arrangements on garments in order to make slight adjustments to the size of the garment. Adjustments to the size of a garment allow two different individuals who are close in size to wear the same size garment. For example, even if two individuals are properly sized to wear the same size bra, one individual may require a slightly larger band size than the other. If the bra includes a series of hook-and-eye fasteners on the band, one of the individuals will use a different combination than the other individual. These size adjustment arrangements on garments not only allow different individuals to wear a common size, but also compensate for slight changes in weight and body dimensions for an individual over time. Therefore, garments with size adjustment arrangements allow a single size garment to be purchased with the knowledge that a new garment will not be required if the individual loses or gains a few pounds.

Size adjustment arrangements on garments are often difficult to adjust. This is especially true when adjustments need to be made while the garment is being worn by the individual, as the size adjustment arrangements are often positioned in locations that are difficult to see or reach. For example, if the hook-and-eye fasteners on the support band of a bra need to be adjusted while wearing the bra, the wearer must reach behind her back, completely release the hook-and-eye fasteners, and then re-engage the fasteners at a different location on the band. Other types of bra fasteners positioned on the rear of the bra present similar difficulties with respect to adjustment of the bra strap.

Size adjustment arrangements positioned on at more accessible locations on a garment present other challenges. These more accessible locations for size adjustment arrangements may limit the number of adjustment options as a result of the selected location. For example, if a hook-and-eye fastener is provided at the front of a bra between the two cups, the number of hook-and-eye options for the wearer is typically limited as the cups should remain properly spaced based on the size of the bra. Additionally, even this more accessible location on the front of the bra may present challenges for size adjustment, as the wearer must properly fasten the small components of the size adjustment arrangement while the visibility of such components remains somewhat limited based on the position of the cups and support band against the body of the wearer.

The foregoing size challenges have resulted in size adjustment arrangements with various alternative fastening arrangements intended to allow the wearer to more easily make adjustments to the garments. However, many of these alternative fastening arrangements present other challenges, such as unwanted bulk, undesirably look and feel, or weak retention capability. For example, hook-and-loop type fastener strips may tend to slide with respect to one another during wear, thus changing the desired fit of the garment.

In view of the foregoing, it would be advantageous to provide a size adjustment mechanism for a bra or other garment that may be easily accessed in order to quickly and conveniently adjust the size of the garment. It would be further advantageous if such size adjustment mechanism was relatively small, provided an acceptable look and feel, and provided strong retention capabilities.

SUMMARY OF THE INVENTION

In accordance with one exemplary embodiment of the disclosure, there is provided a size adjustment arrangement for a garment. The size adjustment arrangement comprises a base member, a ratchet member, a line, a spool, and an actuator. The base member is coupled to the garment and the ratchet member is rotatably coupled to the base member. The spool is coupled to the ratchet member and rotates with the ratchet member. The line is wound on the spool with the line extending through at least one channel in the garment. The actuator is coupled to the ratchet member and is selectively rotatable in a first direction and a second direction without activation of any release mechanism. The ratchet member and spool rotate along with the actuator. When a first force is applied to rotate the actuator in the first direction, the line is wound upon the spool. When a second force is applied to rotate the actuator in the second direction, the line is unwound upon the spool. The ratchet member and the spool are blocked from rotation when neither the first force nor the second force is applied to the actuator.

Pursuant to another exemplary embodiment of the disclosure, there is provided a size adjustment arrangement for a garment. The size adjustment arrangement comprises a base member positioned on the garment, the base member including a recess and a plurality of teeth extending radially inward on a circular track. A ratchet member is rotatably coupled to the base member. The ratchet member includes a first pawl and a second pawl, the first pawl including a first tooth engaging the plurality of teeth and the second pawl including a second tooth engaging the plurality of teeth, with both the first pawl and the second pawl extending past the plurality of teeth in an axial direction. A spool is positioned within the recess and connected to the ratchet member and rotatable therewith. A dial is positioned adjacent to the ratchet member in the axial direction outward from the base. The dial includes a first abutment member and a second abutment member positioned on an interior side of the dial. The first abutment member is configured to engage the first pawl and urge the first tooth out of engagement with the plurality of teeth when the dial is rotated in a first direction. The second abutment member is configured to engage the second pawl and urge the second tooth out of engagement with the plurality of teeth when the dial is rotated in a second direction opposite the first direction. A line wound on the spool with a length of line extending through a channel in the garment. The length of line in the channel is decreased when the dial is rotated in the first direction, and the length of line in the channel is increased when the dial is moved in the second direction.

In accordance with yet another exemplary embodiment of the disclosure, there is provided a size adjustment arrangement for a garment, the size adjustment arrangement comprising a rotatable actuator, a spool and a line. The rotatable actuator is coupled to the spool and mounted on the garment. The rotatable actuator is rotatable in a first direction and a second direction opposite the first direction without activation of any release mechanism. The spool configured to rotate when the actuator is rotated and the spool is prevented from rotation when the actuator is not rotated. The line is wound on the spool and extends into at least one channel in the garment. The line is arranged on the spool such that the line is further wound on the spool when the actuator is rotated in the first direction, the line is unwound on the spool when the actuator is rotated in the second direction, and the line is prevented from winding or unwinding when the actuator is not rotated.

The above described features and advantages, as well as others, will become more readily apparent to those of ordinary skill in the art by reference to the following detailed description and accompanying drawings. While it would be desirable to provide a size adjustment arrangement for a garment that provides one or more of these or other advantageous features, the teachings disclosed herein extend to those embodiments which fall within the scope of the appended claims, regardless of whether they accomplish one or more of the above-mentioned advantages.

DETAILED DESCRIPTION OF THE INVENTION

Figure 1:
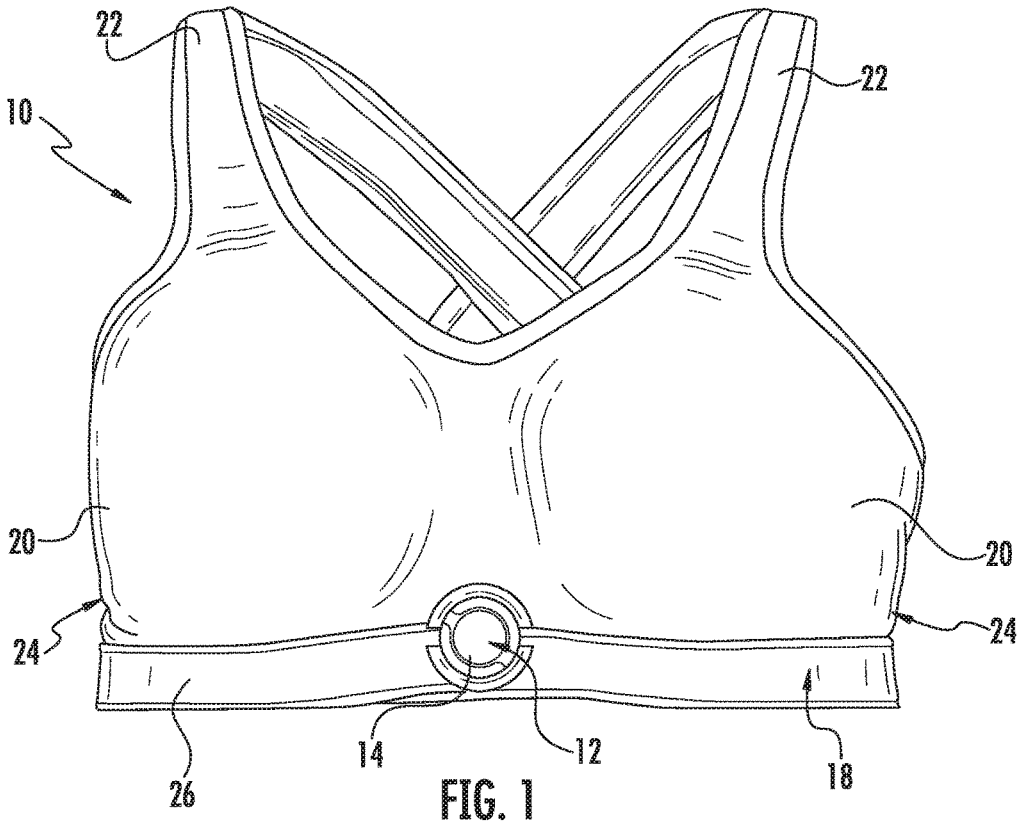
FIG. 1 shows a bra with a size adjustment arrangement provided on the front of the bra.
Figure 2:
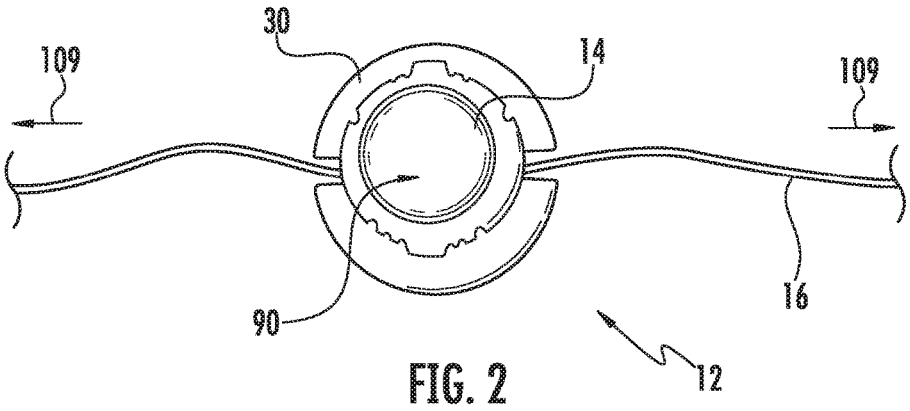
FIG. 2 shows the size adjustment arrangement of FIG. 1 separate from the bra.

With reference to FIGS. 1 and 2, a garment is shown in the form of a bra 10 with a size adjustment arrangement/mechanism 12 positioned thereon. The size adjustment arrangement 12 includes an actuator/dial 14 that is rotatable in either a clockwise direction or a counter-clockwise direction. A line 16 extends from the size adjustment arrangement 12 and through one or more channels 18 in the bra 10. When the dial 14 of the size adjustment arrangement 12 is rotated in the clockwise direction, the line 16 is retracted into the size adjustment arrangement 12, thus reducing the size of the bra 10. When the dial 14 is rotated in the counter-clockwise direction, additional lengths of line are released from the size adjustment arrangement 12 and into the channels 18 of the bra 10, thus increasing the size of the bra 10.

The bra 10 generally includes two cups 20, two shoulder straps 22, side panels 24 and a support band 26. In the exemplary embodiment of FIG. 1, a channel 18 extends along the top of the support band 26 from a front portion to a rear portion of the bra. While exemplary embodiments of the bra 10 and adjustment mechanism 12 are provided herein, it will be recognized that various alternative embodiments of the garment are possible. For example, in other exemplary embodiments, the garment may be provided in other forms, such as a shirt, pants, socks, shoes, headwear, or any of various other types of garments as will be recognized by those of ordinary skill in the art.

With continued reference to FIG. 1, the channels 18 are configured to route the line 16 through the bra 10. The channels 18 are generally defined by fabric panels that are used to form the garment. To this end, the channels 18 may be formed by a loop in the fabric that is finished along a seam or other attachment point to form an elongated channel with at least one open end leading to the size adjustment arrangement 12. In other exemplary embodiments, the channels may be formed between two fabric panels that are joined together along two distinct but parallel seams with the channel provided between the two parallel seams. The channels 18 may be provided by a series of short channels, similar to belt loops, or an elongated channel that extends several inches or feet across the garment. The terms "channel" and "channels" may be used interchangeably herein to refer to the continuous channel or collection of channels extending through the garment. While the channels have been described in various exemplary embodiments herein, it will be appreciated that the term "channel" as used herein references any suitable structure configured to route the line 16 through the garment. In alternative embodiments, the channels 18 may be formed from a material that is different from the fabric used to form the body portions of the garment. For example, in one embodiment the channels 18 may be formed by guides comprised of polymer or other material that are attached to the body of the garment to provide the channels 18.

Figure 8:
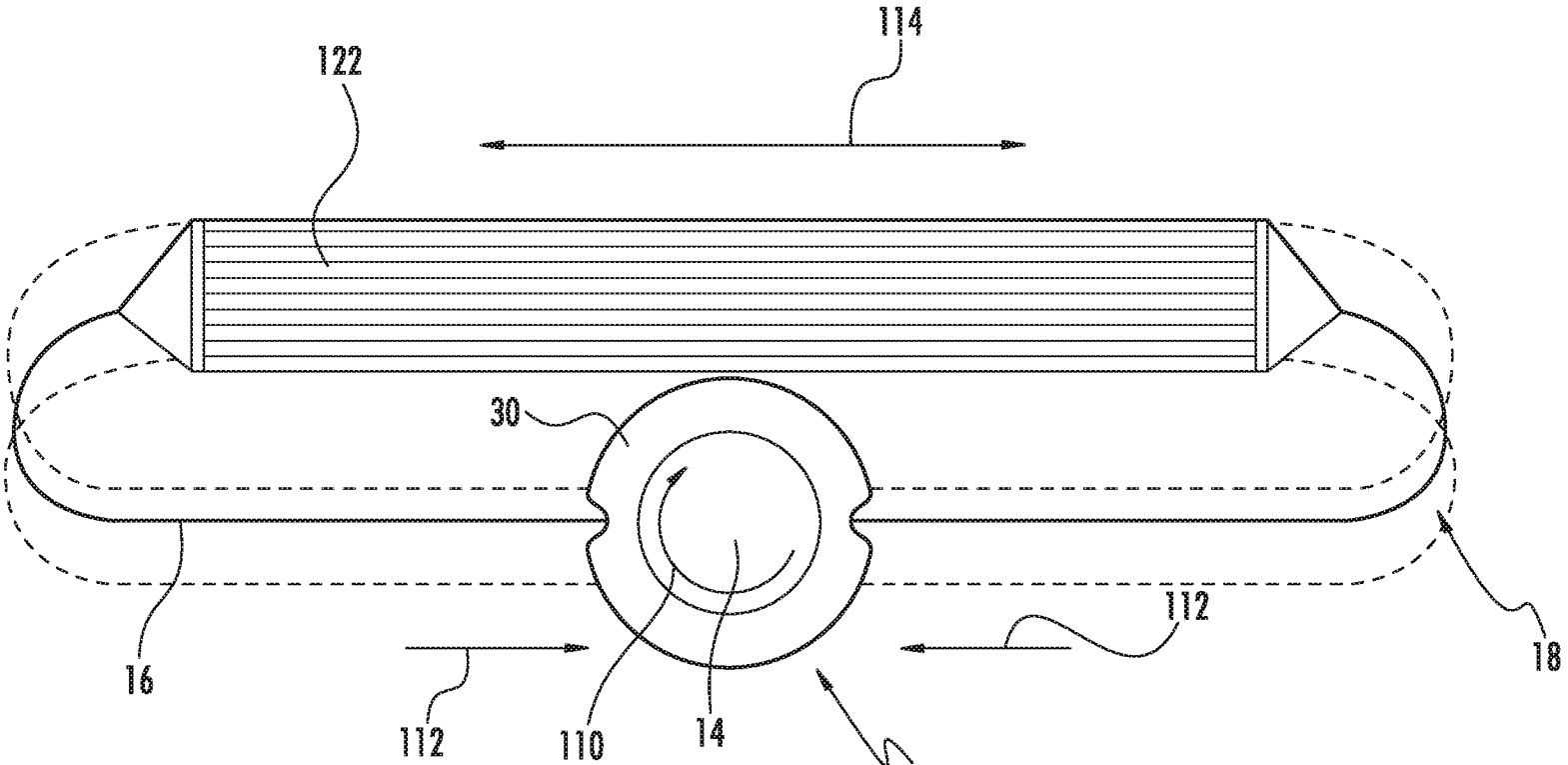
FIG. 8 shows a diagram illustrating movement of a cord within a channel of a garment during operation of the size adjustment arrangement of FIG. 2.
Figure 9A:
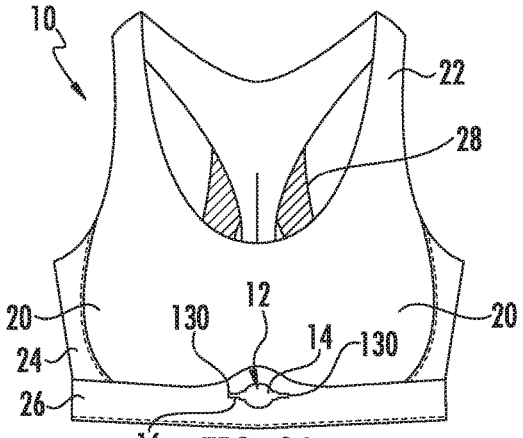
FIG. 9A shows a front view of an alternative exemplary embodiment of a bra with the size adjustment arrangement provided on the front of the bra, the bra including channels configured to route an elongated size adjustment line through the bra.
Figure 9B:
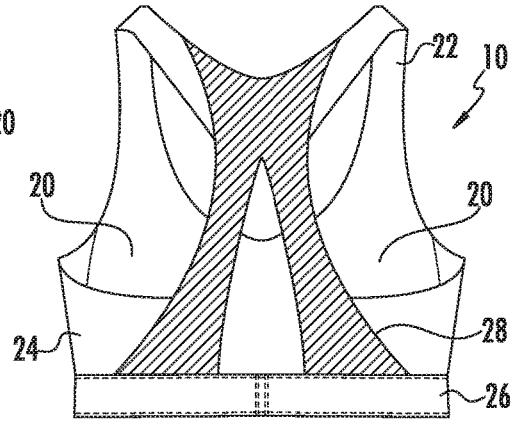
FIG. 9B shows a rear view of the bra of FIG. 9A.
Figure 9C:
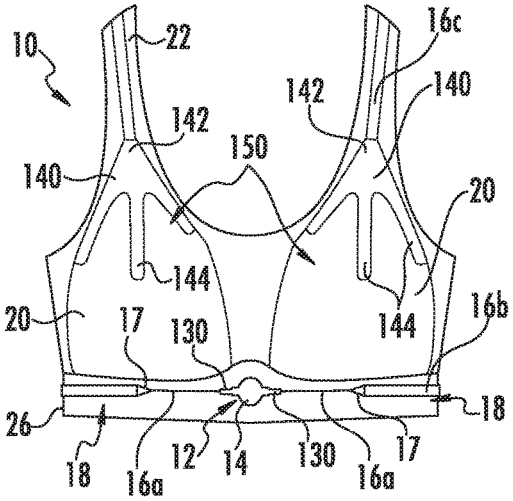
FIG. 9C shows a front view of the bra of FIG. 9A with the outer layer of the bra removed to expose the channels for the size adjustment line.
Figure 9D:
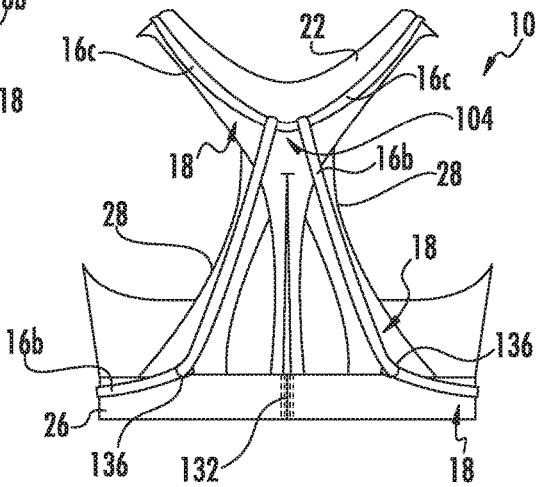
FIG. 9D shows a rear view of the bra of FIG. 9A with the outer layer of the bra removed to expose the channels for the size adjustment line.

Exemplary embodiments of the channels 18 are shown in FIGS. 8, 9C and 9D, and are explained in further detail below. In the exemplary embodiment of FIG. 8, the channels 18 are illustrated with dotted lines that extend along the top of the support band 26 with the line 16 extending through the channels 18. FIGS. 9A and 9B illustrate the channels 18 as extending through the support band 26, along the rear portion/back straps 28, through the shoulder straps 22 of the bra. It will be recognized that FIGS. 8, 9A and 9B show only two exemplary embodiments of the routing of the channels 18, and numerous other embodiments are possible.

The line 16 that is routed through the channels 18 of the bra 10 may be provided in any of various forms, including cord, webbing, lacing, rope, string, wire, or any of various other lines as will be recognized by those of ordinary skill in the art. Furthermore, in various embodiments, the line 16 may include different types of lines coupled together to form the complete line. For example, the line 16 may be provided as a cord at one location and the cord may be coupled to webbing or some other line type at some location within the channel. Therefore, while the line 16 has been described as a "cord" in association with the exemplary embodiment of FIGS. 1-8 described herein, it will be recognized that the cord shown in the exemplary embodiment of FIGS. 1-8 may alternatively be provided in different forms other than a cord. For example, FIGS. 9A-9D show the line 16 as including a cord 16*a* coupled to webbing 16*b* at a particular location on the line 16. Also, the terms "line" and "lines" (or similarly, "cord" and "cords") may be used interchangeably herein to refer to the one or more lines extending through the garment.

With reference now to FIGS. 3-6, the size adjustment arrangement 12 comprises a base member 30, a ratchet member 50 with a spool 80, and the actuator 14. The base member 30 is provided as a unitary component that may be molded or otherwise formed from a generally durable and rigid material, such as a polypropylene or any of various other polymer materials. The base member 30 includes an outer surface that curves in a concave manner between a substantially circular perimeter 32 and an intermediate ledge 34. Slots 33 are formed on opposing sides of the substantially circular perimeter 32 of sufficient size to pass the cord 16. A raised circular rim 35 is positioned outward from the intermediate ledge 34 on the base member 30. A circumferential groove 39 is provided on the base member 30 between the intermediate ledge 34 and the raised circular rim 35.

A cylindrical recess 36 is positioned within the base member 30 and defined within the circular rim 35. A plurality of teeth 40 are positioned within the recess 36 along a circular track 38 located radially inward from the circular rim 35. The teeth 40 are asymmetrical such that a first side 42 of the teeth 40 is angled to a greater degree with respect to a radial direction than a second side 44 of the teeth.

Figure 4:
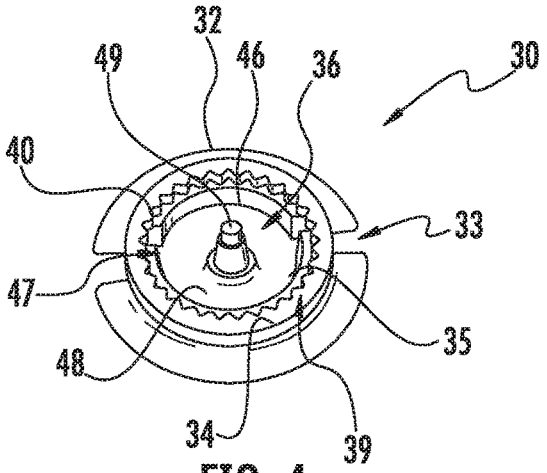
FIG. 4 shows a front perspective view of the base member of FIG. 3 with the dial and the ratchet member removed.

As best shown in FIG. 4, a circular ledge 46 is provided on the base member 30 within the recess 36. The circular ledge 46 is positioned between a floor 48 of the recess 36 and the teeth 40. A spindle 49 extends away from the floor 48 in an axial direction within the cylindrical recess 36. The spindle 49 and circular ledge 46 serve as a boss for the ratchet member 50. Two openings 47 are provided on opposing sides of the floor 48. These openings 47 are aligned with the slots 33 provided along the outer circular perimeter 32 of the base member. Together, the slots 33 and openings 47 provide passages in the base member 30 that are designed and dimensioned to pass the cord 16, allowing the cord to wind and unwind upon the spool 80 within the base member 30, as explained in more detail below.

With reference again to FIGS. 3 and 5A-5C, the ratchet member 50 includes a central hub 52, a bridge 54, a knob 55, a first resilient arm 56, and a second resilient arm 58. The central hub 52 defines a central hole that receives the spindle 49 of the base member. Accordingly, the ratchet member 50 is coupled to the base member 30 with the hub 52 of the ratchet member 50 rotatably positioned on the spindle 49 of the base member 30. Similar to the base member 30, the ratchet member 50 is also comprised of a generally rigid and durable material such as a polypropylene, poly-vinyl chloride, or any of various other polymer materials.

The bridge 54 or the ratchet member 50 extends radially outward from the hub 52. Similarly, the knob 55 of the ratchet member 50 also extends radially outward on an opposite side of the hub 52 from the bridge 54. The knob 55 is peninsula-like and does not lead to any other portions of the ratchet member 50. However, the bridge 54 connects the hub 52 to the first resilient arm 56 and the second resilient arm 58.

The first resilient arm 56 extends arcuately from the bridge, following the contour of the hub 52 along a path that is radially outward from the hub 52. The first resilient arm 56 includes a proximate end 60, a distal end 62, and an elongated portion 64. The proximate end 60 is connected to the bridge 54. The elongated portion 64 extends between the proximate end 60 and the distal end 62. The distal end 62 is free from connection to other portions of the ratchet member 50. A tooth 66 is positioned on the distal end 62 of the first resilient arm 56. The tooth 66 includes an edge 68 that points radially outward from the hub 52, a bridge side 66*a* (see FIG. 7A) of the tooth 66 and a knob side 64*b* (see FIG. 7A) of the tooth. Because the arm 56 is comprised of a resilient material and is elongated, the distal end 62 of the arm 56 is pivotable with respect to the bridge 54 of the ratchet member 50. In particular, when a radially inward force is applied to the distal end 62 of the arm 56, the distal end 62 and tooth 66 are moved in a radially inward direction. When the radially inward force is removed, the resilient nature of the arm 56 causes the distal end 62 and the tooth 66 to move in a radially outward direction, back to an equilibrium position.

Figure 3:
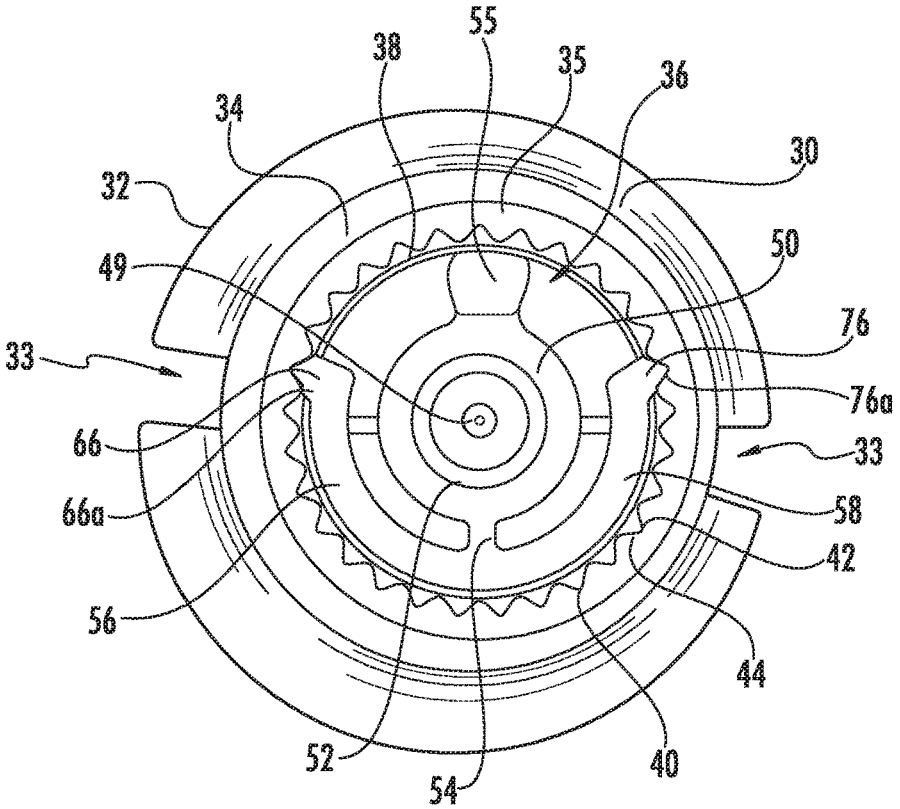
FIG. 3 shows a front view of the size adjustment arrangement of FIG. 2 with a dial removed from a base member of the size adjustment arrangement to expose a rotatable ratchet member.

As shown in FIG. 3, the tooth 66 of the first arm 56 is configured to intermesh with the teeth 40 of the base member 30. In particular, the tooth 66 is designed and dimensioned to fit into each of the inter-dental spaces (i.e., recesses) formed between the teeth 40 on the base member 30, with the pointed edge 68 of the tooth 66 fitting deep into the recess. However, the tooth 66 of the first arm 56 is thicker in the axial direction than the teeth 40 on the base member 30. Accordingly, although the tooth 66 of the first arm 56 fits into the recesses between the teeth 40 on the base member 30, a portion of the tooth 66 always remains outside of the recesses between the teeth 40 in the axial direction. In other words, a portion of the tooth 66 of the first arm 56 is always exposed above the circular track 38 of the base member. As explained in further detail below, the pivoting action of the first arm 56 allows the tooth 66 of the first arm 56 to provide a first pawl for the ratchet member 50.

The second arm 58 is substantially symmetrical with the first arm 56 and extends arcuately from an opposite side of the bridge 54 from that of the first arm 56. Accordingly, the second arm 56 also includes a proximate end 70, and elongated portion 74, and a distal end 72 with a tooth 76. The tooth 76 includes a bridge side 76*a* and a knob side 76*b*. Similar to the tooth 66 on the first arm 56, the tooth 76 on the second arm 58 is also thicker in the axial direction than the teeth 40 on the base member 30 such that the tooth 76 extends above the teeth 40 in the axial direction. One distinction between the first arm 56 and the second arm 58 is that the tooth 78 on the second arm 58 is not positioned as far to the distal end 72 as the tooth 66 on the distal end 62 of the first arm 56. Similar to the first arm 56, the second arm 58 is also configured to pivot with respect to the bridge 54. As explained in further detail below, the pivoting action of the second arm 58 allows the tooth 76 of the second arm 58 to provide a second pawl for the ratchet member 50.

Figure 5A:
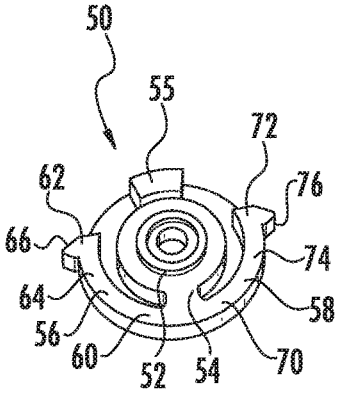
FIG. 5A shows a front perspective view of the ratchet member of FIG. 3.
Figure 5B:
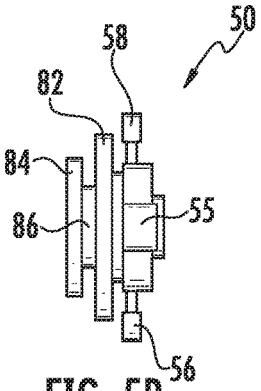
FIG. 5B shows a side view of the ratchet member of FIG. 3.
Figure 5C:
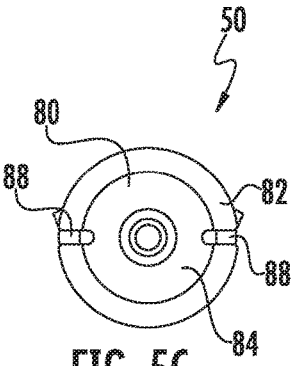
FIG. 5C shows a rear view of the ratchet member of FIG. 3.

As best shown in FIGS. 5A-5C, the spool 80 is connected to the ratchet member 50. In the disclosed embodiment, the spool 80 is integral with the ratchet member 50, and thus the spool 80 and ratchet member 50 are provided as a unitary component. The spool 80 includes a first radial wall 82, a second radial wall 84, and a cylinder 86 extending between the first radial wall and the second radial wall.

The first radial wall 82 is connected to the hub 52 of the ratchet member 50 on an axially inward side of the hub 52. The first radial wall 82 is designed and dimensioned to abut and the circular ledge 46 in the recess 36 of the base member 30. The surface of the first radial wall 82 is substantially smooth such that the first radial wall 82 is allowed to slide upon on the smooth surface of the circular ledge when the spool 80 rotates. The first radial wall 82 also includes radial slots 88 on opposing sides of the radial wall 82. The radial slots 88 are relatively thin such that the cord 16 is retained in the slots 88 by friction when the cord 16 is slid into the slots 88.

Similarly, the second radial wall 82 of the spool is designed and dimensioned to engage the floor 48 in the recess 36. Thus, the second radial wall 84 is positioned deeper in the recess than the first radial wall 82. The surface of the second radial wall 84 is smooth such that the second radial wall 84 is allowed to slide upon the smooth surface of the floor 48 when the spool 80 rotates.

The cylinder 86 of the spool 80 is positioned between the first radial wall 82 and the second radial wall 84. The cylinder 86 separates the first radial wall 82 and the second radial wall 84 by a distance that is about two to five times the thickness of the cord 16, thus allowing the cord to freely wrap around the cylinder 86 without being wedged between the first radial wall 82 and the second radial wall 84. The spindle 49 extends through the cylinder and into the opening at the center of the hub 52 of the ratchet member 50. Accordingly, the diameter of the cylinder 86 is greater than that of the spindle 49.

Figure 6:
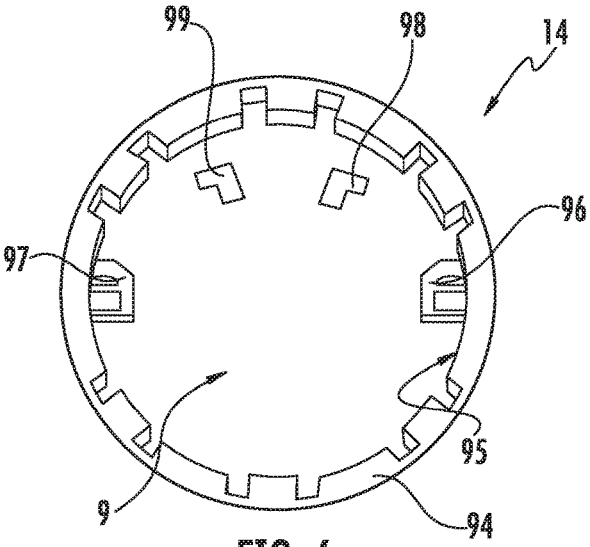
FIG. 6 shows an interior side of the dial of FIG. 2 including various tabs configured to engage the ratchet member.

As discussed previously, an actuator in the form of the dial 14 covers the ratchet member 50 within the base member 30. The dial 14 is located adjacent to the ratchet member 50 in the axial direction outward from the base member 30. The dial 14 includes an outer face 90, as shown in FIG. 2, and an inner face 92, as shown in FIG. 6. A skirt 94 is provided along the perimeter of the dial 14, extending in a posterior direction from the outer face 90 and past the inner face 92. The skirt 94 includes an end lip 95 that engages the circumferential groove 39 on the base member surrounding the circular rim 35, thus retaining the dial 14 on the base member 30.

As shown in FIG. 6, the inner face 92 of the dial 14 includes four abutment members configured to abut components of the ratchet member 50. In particular, the inner face 92 of the dial 14 includes two arm tabs 96 and 97 and two knob tabs 98 and 99. Arm tab 96 is configured to engage the bridge side 66*a* (see FIG. 3) of the tooth 66 on the first arm 56 of the ratchet member 50. Arm tab 97 is configured to engage the bridge side 76*a* (see FIG. 3) of the tooth 76 on the second arm 58 of the ratchet member 50. Engagement of the arm tab 96 with the tooth 66 and the arm tab 97 with the tooth 76 occurs on a portion of each tooth that is axially outward from the teeth 40 of the base member 30. In particular, as discussed previously, a portion of each tooth 66 and 76 on the ratchet member 50 extends axially outward from the teeth 40 on the base member 30 when the teeth 66 and 76 on the ratchet member 50 meshingly engage the teeth 40 on the base member 30. Accordingly, it is this portion of each tooth 66 and 76 that is configured for engagement with the abutment members on the inner face 92 of the dial in the form of right arm tab 96 and left arm tab 97 (the terms "left" and "right" are used herein from the perspective of the wearer). Engagement of the arm tabs 96 and 97 with the arms 56 and 58, respectively, causes the arms 56 and 58 to pivot during rotation of the dial 14, as explained in further detail below.

Similar to the arm tabs 96 and 97 the knob tabs 98 and 99 are configured to engage the knob 55 on the ratchet member 50. Knob tab 98 is configured to engage one side of the knob 55 and knob tab 99 is configured to engage the opposite side of the knob 55. Engagement of the knob tabs 98 and 99 with the knob 55 provides a rotational force on the ratchet member 50 when the dial 14 is rotated, as explained in further detail below.

Operation of the size adjustment arrangement 12 is now explained with reference to FIGS. 7A and 7B. Although FIGS. 7A and 7B show the dial 14 removed from the base member 30 to illustrate movement of the ratchet member 50, it will be understood that the dial 14 is actually positioned on the base member 30 to cover the ratchet member 50 during operation of the size adjustment arrangement 12.

Figure 7A:
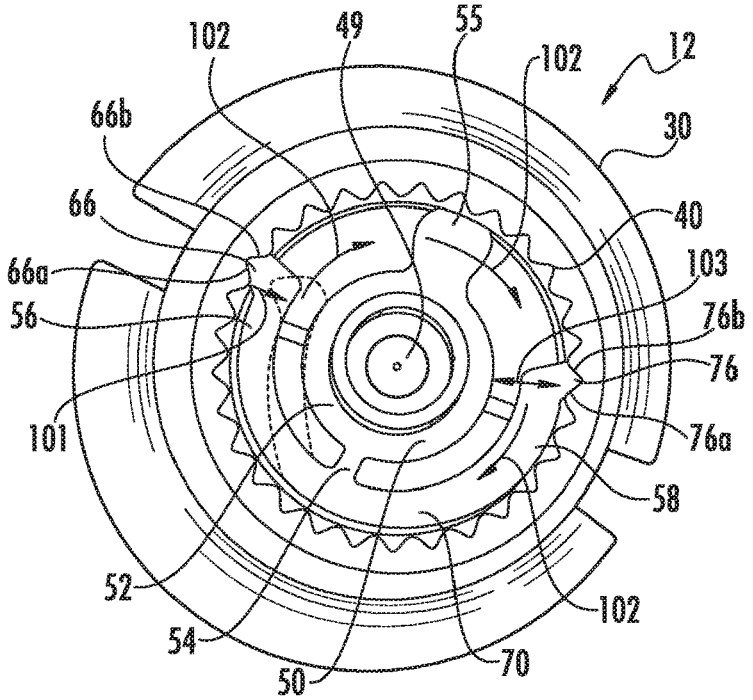
FIG. 7A shows a front view of the ratchet arrangement of FIG. 3 including arrows to illustrate operation of the ratchet member and the size adjustment arrangement when the dial is rotated in a clockwise direction.

FIG. 7A illustrates movement of the ratchet member when the dial 14 is rotated in the clockwise direction. When the user rotates the dial 14 in the clockwise direction, the right arm tab 96 on the dial 14 engages the bridge side 66*a* of the tooth 66 on the right resilient arm 56 of the ratcheting member 50. Continued rotation of the dial 14 in the clockwise direction causes the right arm tab 96 on the dial 14 to impart a force on the tooth 66 that urges the right resilient arm 56 radially inward, as illustrated by arrow 101 and the associated dotted lines outlining a pivoted position for the right resilient arm 56 in FIG. 7A. At the same time, the right knob tab 98 engages the right side of the knob 55, imparting a circumferential force on the ratchet member 50 that urges the ratchet member 50 to rotate in a clockwise direction about the spindle 49 of the base member 30, as illustrated by arrows 102. During this rotation, the tooth 66 on the right resilient arm 56 is moved out of contact with the teeth 40 on the base member 30, allowing the right resilient arm 56 to freely rotate within the base member 30. However, during this rotation, the tooth 76 on the left resilient arm 58 remains engaged with the teeth 40 of the base member 30. Nevertheless, because the left resilient arm 58 is configured to pivot at the proximate end 70 of the arm, the left resilient arm 58 moves back and forth in a ratcheting fashion, as illustrated by arrow 103, as the tooth 76 of the left resilient arm 58 slides over the teeth 40 on the base member 30. Rotation of the ratchet member 50 also results in rotation of the spool 80. Accordingly, the cord 16 which is coupled to the spool 80 is wound (or unwound) upon the spool 80 as the ratchet member 50 and spool rotate.

Figure 7B:
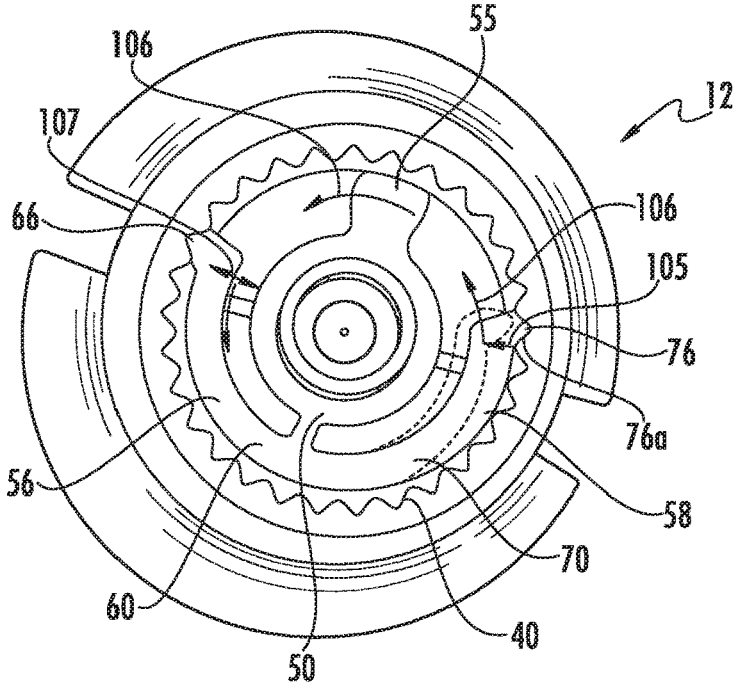
FIG. 7B shows a front view of the ratchet arrangement of FIG. 3 including arrows to illustrate operation of the ratchet member and the size adjustment arrangement when the dial is rotated in a counter-clockwise direction.

In the same manner, FIG. 7B illustrates operation of the size adjustment arrangement 12 when the user rotates the dial 14 in the opposite direction (i.e., the counter-clockwise direction). When the user rotates the dial 14 in the counter-clockwise direction, the left arm tab 97 on the dial 14 engages the bridge side 76*a* of the tooth 76 on the left resilient arm 58. Continued rotation of the dial 14 in the counter-clockwise direction causes the left arm tab 97 on the dial 14 to impart a force on the tooth 76 that urges the left resilient arm 58 radially inward, as illustrated by arrow 105 and the associated dotted lines in FIG. 7B. At the same time, the left knob tab 99 of the dial 14 engages the left side of the knob 55, imparting a circumferential force on the ratchet member 50 that urges the ratchet member 50 to rotate in the counter-clockwise direction about the spindle 49 of the base member 30, as illustrated by arrows 106. During this rotation, the tooth 76 on the left resilient arm 58 is moved out of contact with the teeth 40 on the base member 30, allowing the left resilient arm 56 to freely rotate within the base member 30. However, during this rotation, the tooth 66 on the right resilient arm 56 remains engaged with the teeth 40 of the base member 30. Nevertheless, because the right resilient arm 56 is configured to pivot at the proximate end 60 of the arm, the right resilient arm 56 moves back and forth in a ratcheting fashion, as illustrated by arrow 107, as the tooth 66 of the right resilient arm 56 slides over the teeth 40 on the base member 30. Once again, rotation of the ratchet member 50 also results in rotation of the spool 80. Accordingly, the cord 16 which is coupled to the spool 80 is unwound (or wound) upon the spool 80 as the ratchet member 50 and spool rotate.

As described above with reference to FIGS. 7A and 7B, rotation of the dial 14 results in rotation of the ratchet member 50 and spool 80 within the base member 30. This rotation of the ratchet member 50 and spool 80 results in the cord 16 being wound or unwound on the spool 80. Furthermore, it will be recognized that the user is able to rotate the dial 14 in the clockwise or counter-clockwise direction without activation of any release mechanism. Thus, the user may simply rotate the dial 14 in order to adjust the length of the cord 16 wound upon the spool 80. However, when the dial 14 is not rotated (i.e., is stationary with no rotational force imparted to the dial 14), the ratchet member 50 and spool 80 are blocked from rotation within the base member 30, and the length cord 16 wound on the spool 80 is locked. In particular, when no rotational force is applied to the dial 14, both the first and second resilient arms 56, 58 remain engaged with the teeth 40 of the base member 30. Accordingly, when the cord 16 is pulled outward from the size adjustment arrangement in a radial direction, as shown by arrows 109 in FIG. 2, either tooth 66 of the first resilient arm 56 or tooth 76 of the second resilient arm 58 is driven further into the teeth 40, depending upon the direction of rotation imparted to the ratcheting member 50 by the cord 16 being pulled in an outward direction. When tooth 66 or 76 is driven into the teeth 40, the surface on the knob side 66*b* or 76*b* of the tooth is forced into the sloped surface on one of the teeth 40 in a direction that is substantially perpendicular to the surfaces of the abutting teeth. At the same time, it will be noted that the tooth 66 or 76 is being moved in a direction away from the associated arm tab 96 or 97 on the dial 14, so there is no component to urge movement of the arm 56 or 58 away from the tooth 66 or 76. Accordingly, the direct abutment between the surfaces of the teeth (i.e., tooth 66 or 76 and one of teeth 40) blocks the ratchet member 50 from rotating within the base member 30 when a rotational force is applied to the spool 80 and ratchet member 50 by the cord 16 being pulled in a radially outward direction from the base member 30. Furthermore, because an outside rotational force is not being imparted to the dial 14 by the user, there is no force being applied to either of the resilient arms 56 or 58, so these arms remain in position to block rotation of the ratchet member 50 and the spool 80.

If the user does desire to rotate the spool 80 in order to the change the length of the cord 16 extending away from the adjustment arrangement 12, the user simply rotates the dial 14. Rotation of the dial 14 places a force on one of the arms 56 or 58 of the ratchet member 50, pivoting the arm 56 or 58 out of engagement with the teeth 40, and allowing the ratchet member 50 and spool 80 to rotate within the base member 30, as described above. This rotation of the ratchet member 50 and spool 80 is a ratcheting rotation based on the opposite arm 58 or 56 continuing to engage the 40 teeth in a ratcheting manner during rotation of the ratcheting member 50 and spool 80.

With reference now to FIG. 8, the size adjustment arrangement 12 is illustrated with the cord extending through an exemplary channel 18 in a garment (the channel 18 is shown in dotted lines in FIG. 8 and formed between two layers of fabric or other sheets of material positioned within a garment). When the user rotates the dial 14 in a clockwise direction as indicated by arrow 110 in FIG. 8, the spool 80 of the adjustment arrangement 12 rotates, causing the cord 16 to wind upon the spool 80. When the cord 16 is wound upon the spool, the cord 16 moves radially inward toward the spool 80, as shown by arrows 112 in FIG. 8. This shortens the length of the cord in the channel 18 and pulls on an elastic member 122 on the garment, as shown by arrows 114. As the elastic member 122 stretches, the garment becomes tighter upon the user, effectively making the size of the garment smaller. Once a comfortable garment size is achieved, the user ceases rotation of the dial 14, thus locking the ratcheting member 50 and spool 80 in place within the base member 30, as described above. Only upon further rotation of the dial 14 by the user (or another party) will the length of the cord 16 be changed to increase or decrease the size of the garment. To this end, the user may increase the size of the garment by rotating the dial 14 in order to increase the size of the garment for easy removal and subsequent donning. Once the garment is donned again, the user may then choose to rotate the dial 14 to tighten the garment to an appropriate size for the individual.

With reference now to FIGS. 9A-9D in another exemplary embodiment, the channels 18 in the garment extend through the support band 26 and then feed into the back straps 28. The channels 18 then extend through the shoulder straps 22 of the bra and into an area on the front of the bra where the cups 20 are located. The line 16 extends from the size adjustment arrangement 12, through the channels 18 and is coupled to the cups 20 via a load spreader 140, as described in further detail below.

As shown in FIGS. 9A-9D, the dial 14 of the size adjustment arrangement 12 for the bra 10 is positioned on the center front of the support band 26 so that it is easily accessible. The line 16 extending from the size adjustment arrangement enters the channels 18 through two small openings 130 in the support band 26 on opposite sides of the size adjustment arrangement 12. As best seen in FIG. 9C, the line 16 includes a cord portions 16*a* and webbing portions 16*b* that are coupled together in the channel by load spreaders 17. The cord portions 16*a* have a relatively small diameter (e.g., about 0.5-2 mm in the disclosed embodiment), and may have a substantially circular or relatively flat cross-section. The webbing portions 16*b* have substantially thicker in diameter (e.g., about 3-8 mm in the disclosed embodiment) than the cord portions 16*a*. The load spreaders 17 are generally triangular in shape with one tip attached to the cord 16*a* and an elongated side attached to the webbing 16*b*. The load spreaders 17 are generally non-stretch and comprised of a durable material, such as a relatively rigid polymer.

With continued reference to FIG. 9C, the channels 18 extend from the front portion of the bra 10 laterally along the support band 26 toward the rear portion of the bra 10. As shown in FIG. 9D, at the rear portion of the bra 10, the channels 18 feed into the back straps 28. Thus, in the embodiment of FIGS. 9A-9D, the channels 18 do not extend to a central location on the rear portion of the bra 10, as noted by hook and eye coupling 132. However, in other embodiments, the channels 18 may extend to a position much closer to the central location on the rear portion of the bra. A plastic ring 136 is provided at the transition between the support band 26 and the back straps 28. The plastic ring 136 facilitates a smooth transition in the channels 18 between the support band 26 and the back straps 28.

With continued reference to FIG. 9D, the channels 18 extend upward along the back straps 28 of the bra 10 and feed into the shoulder straps 22. A webbing transition location 134 is provided in the channels 18 near the coupling of the shoulder straps 22 to the back straps 28 (i.e., at an upper back portion of the bra 10). At this location, the portion of webbing 16*b* in the line 16 is coupled to an additional portion of webbing 16*c*. In particular, the end of the webbing 16*b* is wrapped around the webbing 16*c* and fastened to itself, thus forming a loop that couples webbing 16*b* to webbing 16*c*. Both the left and right lines of webbing 16*b* are coupled to the webbing 16*c* in this manner, as shown in FIG. 9D.

With continued reference to FIGS. 9C and 9D, the channels 18 continue along the shoulder straps 22 and extend from the rear portion of the bra 10 to the front portion of the bra 10. At the front portion of the bra 10, the channels 18 feed into cup cavities 150, where the cups 20 are held on the bra 10. At this general location, the ends of the webbing 16*c* are coupled to a load spreader 140. The load spreader 140 is generally triangular in shape with a top apex 142 and multiple fingers 144. The top apex 142 is coupled to the webbing 16*c*, and the fingers 144 are coupled to the cups 20 of the bra 10. The load spreader 140 may be either an elastic or non-elastic member. The load spreader is generally comprised of a soft, yet resilient and durable material, such as a resilient polymer or leather material.

In operation of the bra shown in FIGS. 9A-9D, the wearer may rotate the dial 14 to draw the line 16 into the size adjustment mechanism 12 or release the line 16 from the size adjustment mechanism 12. When the wearer draws the line 16 into the size adjustment mechanism 12, the length of line 16 in the channels 18 is reduced, thus tightening the fit for the wearer. Drawing the line 16 in may also provide additional support for the wearer in the cup area. Similarly, when the wearer releases additional line 16 into the channels, the fit of the bra is enlarged or relaxed. As a result, less support may be provided for the wearer in the cup area.

The foregoing detailed description of one or more exemplary embodiments of the size adjustment arrangement for a garment has been presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed exemplary embodiments and other features and functions, or alternatives thereof, may be desirably combined into many other different embodiments, systems or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the exemplary embodiments contained herein.

What is claimed is:

1. A garment comprising:

a garment channel extending through the garment; and an adjustment arrangement including:

an actuator selectively rotatable in a first actuator direction and a second actuator direction, a rotatable ratchet member in communication with the actuator, the ratchet member including a spool, and a cord having a predetermined length and mounted on the spool, the cord further being positioned within the garment channel, wherein rotating the actuator in the first actuator direction repositions the cord within the garment channel in a first cord direction and rotating the actuator in the second actuator direction repositions the cord within the garment channel in a second cord direction.

2. The garment according to claim 1, wherein the adjustment arrangement further comprises a track with a plurality of radially-extending teeth.

3. The garment according to claim 2, wherein the ratchet member further comprises a first resilient arm and a second resilient arm, each resilient arm being adapted to engage the plurality of track teeth.

4. The garment according to claim 3, wherein:

the ratchet member further comprises a central hub;

the first resilient arm extends arcuately around a first perimeter portion of the hub, the first arm operable to engage the track teeth; and the second resilient arm extends arcuately around a second perimeter portion of the hub, the second arm being operable to engage the track teeth.

5. The garment according to claim 4, wherein:

the adjustment arrangement further comprises a base including a recess; and the recess defines the track, the track being a circular track with the plurality of teeth extending radially inward.

6. The garment according to claim 5, wherein:

the base further includes a circumferential groove extending along an exterior portion of the base; and the actuator further comprises a skirt extending axially from a face of the actuator, the skirt including a lip configured to extend into the circumferential base groove.

7. The garment according to claim 6, wherein:

an inner face of the actuator includes a first abutment member and a second abutment member;

the first abutment member is configured to engage the first resilient arm when the actuator is rotated in the first direction and to urge the first arm out of engagement with the plurality of track teeth; and a second abutment member configured to engage the second arm when the actuator is rotated in the second direction and to urge the second arm out of engagement with the plurality of track teeth.

8. The garment according to claim 1, wherein the adjustment arrangement further comprises a first arm and a second arm, each arm movable from an engaged position to a disengaged position upon actuation of the actuator.

9. The garment according to claim 8, wherein:

in a normal, stationary position, each of the first arm and the second arm is disposed in the engaged position; and as the actuator is rotated in either the first actuator direction or the second actuator direction, one of the first arm and the second arm is moved from the engaged position to the disengaged position.

10. The garment according to claim 9, wherein:

the adjustment arrangement includes a track comprising a plurality of teeth; and the first arm and the second arm each includes a tooth operable to mesh with the track teeth.

11. The garment according to claim 10, wherein a length of the cord in the garment channel is decreased when the actuator is rotated in the first actuator direction and increased when the actuator is rotated in the second actuator direction.

12. The garment according to claim 1, wherein:

in the first actuator direction, a dimension of the garment is reduced; and in the second actuator direction, the dimension of the garment is increased.

13. The garment according to claim 1, wherein the actuator is rotatable without prior activation of a release mechanism.

14. The garment according to claim 1, wherein the cord is mounted on the spool such that, in the first actuator direction, the cord is wound onto the spool, and in the second actuator direction, the cord is unwound from the spool.

* * * * *